United States Patent [19]

Considine

[11] Patent Number: 4,841,710

[45] Date of Patent: Jun. 27, 1989

[54] STRUCTURAL WALL PANEL, METHOD OF MANUFACTURE AND ASSEMBLY SYSTEM FOR A HOUSING UNIT

[75] Inventor: Richard Considine, Chestertown, N.Y.

[73] Assignee: The Original Lincoln Logs Ltd., Chestertown, N.Y.

[21] Appl. No.: 76,751

[22] Filed: Jul. 23, 1987

[51] Int. Cl.[4] ..... E04B 2/56; E04G 21/14

[52] U.S. Cl. ..... 52/741; 52/745; 52/275; 52/221

[58] Field of Search ..... 52/309.9, 309.11, 406, 52/407, 806, 807, 828, 92, 309.4, 221, 446, 443, 309.15, 309.1, 275, 272, 741, 745; 428/71, 76

[56] References Cited

U.S. PATENT DOCUMENTS

| | | | |
|---|---|---|---|
| 2,020,908 | 12/1935 | Scammell | 52/446 |
| 2,179,678 | 11/1939 | Wenzel | 52/407 |
| 2,730,772 | 1/1956 | Jones | 20/4 |
| 3,000,144 | 9/1961 | Kitson | 52/443 |
| 3,141,206 | 7/1964 | Stephens | 52/809 |
| 3,149,437 | 9/1958 | Wheeler-Nicholson | 50/373 |
| 3,258,889 | 7/1966 | Butcher | 52/65 |
| 3,350,257 | 10/1967 | Hourigan et al. | 52/309.15 |
| 3,413,765 | 12/1968 | Williams et al. | 52/99 |
| 3,449,879 | 6/1969 | Bloom | 52/309 |
| 3,500,597 | 3/1970 | McKenzie | 52/828 |
| 3,643,393 | 2/1972 | Pierce et al. | 52/309.1 |
| 3,665,662 | 5/1972 | Timbrook et al. | 52/92 |
| 3,683,569 | 8/1972 | Holm | 52/221 |
| 3,686,815 | 8/1972 | Von Bose | 52/743 |
| 3,716,954 | 2/1973 | Kelbish | 52/79 |
| 3,775,982 | 9/1973 | Schmidt | 52/295 |
| 3,777,430 | 12/1973 | Tischuk | 52/309 |
| 3,835,601 | 9/1974 | Kelbish | 52/79 |
| 4,071,984 | 2/1978 | Larrow | 72/79.1 |
| 4,147,004 | 4/1979 | Day | 52/309.11 |
| 4,174,004 | 4/1979 | Day et al. | 52/309.9 |
| 4,241,555 | 12/1980 | Dickens et al. | 52/454 |
| 4,269,006 | 5/1981 | Larrow | 52/79.1 |
| 4,284,447 | 8/1981 | Dickens et al. | 156/78 |
| 4,330,921 | 5/1982 | White | 428/76 |
| 4,349,995 | 9/1982 | Dowler et al. | 52/241 |
| 4,409,768 | 10/1983 | Boden | 52/309.4 |
| 4,671,032 | 6/1987 | Reynolds | 52/807 |
| 4,758,909 | 4/1986 | Henley et al. | 52/92 |

OTHER PUBLICATIONS

"Thermo-Home Zero Energy Wall Panels" brochure.

*Primary Examiner*—James L. Ridgill, Jr.
*Attorney, Agent, or Firm*—Fleit, Jacobson, Cohn & Price

[57] ABSTRACT

A wall panel section includes a panel with two opposite lateral edges, a top edge and a bottom edge. A stud is secured to the panel at one lateral edge and projects beyond the one lateral edge. A core is secured to the panel and is recessed from the other lateral edge of the panel. The stud and the core are recessed from the top edge and the bottom edge of the panel.

4 Claims, 5 Drawing Sheets

STRUCTURAL WALL PANEL, METHOD OF MANUFACTURE AND ASSEMBLY SYSTEM FOR A HOUSING UNIT

BACKGROUND OF THE INVENTION

In recent years, building construction techniques have experienced a rapid transition from traditional "stick" building to less labor intensive methods. Among these newer developments, "panelization" has emerged as one of the more promising building construction methods. This success is due primarily to two attributes of panelized building systems: (1) opportunity for extensive customization; and (2) substantially reduced construction time as evidenced by erection of a weather-tight shell in a week or less. Residential and commercial customers alike continue to find this combination extremely desirable.

Accompanying the favorable aspects of panelization is an ongoing problem. While panels can be fabricated in endless variety to very exacting specifications, this is rarely the case for site built concrete or masonry building foundations. "Stick" builders have long been accustomed to contending with foundations constructed to inaccurate dimensions, out of plumb, level, and/or square in any variety of degrees and combinations. Due to a lack of adequate controls, every site constructed concrete or masonry building foundation will sustain one or all of these inconsistencies to some degree. This condition is expected to continue for the foreseeable future.

For panelizers who wish to build rapidly and repetitively to ideal sizes, this is a serious and potentially expensive problem. Even slight discrepancies result in enormous cost overruns due to the increased number of man-hours required to "adjust" prefabricated panels and/or existing building foundations.

In 1985, approximately 25 to 35 percent of all homes built were to some degree erected by the home owner or the home owner acting as a general contractor. Many of these homes included prefabricated wall panels to reduce the cost of construction. Typically, prefabricated wall panels appeal to the first time home owner, retirees and the home owner with the need for additional space. Affordable housing is thereby made available without compromising quality, style and thermal efficiency.

An example of a prefabricated wall panel is disclosed in U.S. Pat. No. 3,665,662 to Timbrook et al. In this patent a structural member is made of a rectangular rigid core of 3⅝ inch thick expanded resin impregnated honeycomb kraft paper. Glued on both sides of the core is a one-half inch thick board. The core is recessed from one lateral edge and projects from an opposite lateral edge. Horizontal channels are formed by the recessed top and bottom surfaces of the core.

Adjacent structural members interlock with each other and rest upon a sole plate which is supported by a foundation. The location for receptacles, switches and fixtures are marked on the interior panel. The panel is then cut to permit the insertion of the receptacles, switches and fixtures therein at the cut-out location. Conduit is extended through the honeycomb core to make suitable connections to the receptacles, switches and fixtures.

Another example of a prefabricated wall panel is a prior commercial panel referred to generally in the literature as a "stress skin" panel.

SUMMARY OF THE INVENTION

By the present invention, a pre-engineered, super-insulated solid wall panel system has been designed that is unique to the industry in its ability to accommodate even large inaccuracies in existing foundations. While other panel manufacturers endeavor to build complete buildings to exact sizes, the inventive system is predicated on the assumption that site built structures are never made to exact, ideal sizes or configurations. By prefabricating only the major portion of each exterior wall surface and by assuming that the remaining 1" to 3'-11" of one side, or preferably both sides, at each vertex of the exterior wall surface will be site built, a panel system has been created which is uniquely adaptable to unfavorable site conditions.

By utilizing this system, the erecting crew can quickly build to any angle and can, with similar speed, add to or subtract from the ideal exterior dimension as site conditions necessitate. This is the only system that can truly state this uniqueness and allows even the semi-qualified carpenter to make the system "fit" on an inaccurate building foundation.

An advantage of this technique is the use of a rigid insulating material, expanded polystyrene (EPS), preferably one pound density, to which studs and exterior sheathing can be bonded. Accordingly, top and sole plates are cut and installed on-site to the exact size of the building, and studs are added by stick building at the corners, as required to complete the exterior wall.

A typical sequence might include the nailing of the sole plate to an existing, site built floor system (slab or wood frame). Wall panels are erected in clockwise sequence around the building perimeter, leaving spaces at the vertices. A top plate is installed on top of the wall panels, cut to the exact size of the building. Additional studs are installed as necessary to frame corners (vertices), toe-nailed into the bottom plate and secured at the top by nailing downward through the top plate. Interior partitions are built. A double (or "very") top plate is installed. "Inter-stud" spaces at the corners are insulated with field cut expanded polystyrene. This sequence completes the wall frame, window and door openings contained within the prefabricated wall system. By pre-planning a small proportion of "stick" building into the erection process, a major problem for panelization has been solved.

The present invention includes pre-engineered structural wall panels, a method for their manufacture and a system of assembly of wall panels into structural units. The wall panels of the present invention consolidate four different processes of construction which include framing, insulation, exterior sheathing, and siding.

The wall panels assembled into structural units effectively replace stick built housing units. The super-insulated, solid wall construction components of wall panels offer substantially reduced labor costs due to their ease of erection with increased energy efficiency by utilization of expanded polystyrene as the insulating material. In addition, the flexibility of design in assembling wall panels is equal to that of stick built technology. The wall panels which form a structural unit result in an extremely energy efficient, weather tight shell.

Each pre-engineered structural wall panel includes at least one 2×6 inch stud and five-and-a-half-inch thick expanded polystyrene section. The stud(s) and EPS section(s) are laminated and adhered to exterior sheeting ($\frac{5}{8}$ inch wafer board) and pressed to produce a wall panel section substantially stronger than the traditionally wood-framed house. A series of wall panels are assembled on a flat concrete slab foundation to form a precision engineered house which is approximately 50 to 60 percent more energy efficient than conventional stick built construction.

It is the object of the present invention to provide a wall panel section including a panel with two opposite lateral edges, a top edge and a bottom edge, a stud secured to the panel at one lateral edge and projecting beyond the one lateral edge, and a core secured to the panel and being recessed from the other lateral edge of the panel, the stud and the core being recessed from the top edge and the bottom edge of the panel.

It is another object of the present invention to form a structural housing unit having a foundation, a sole plate mounted on a periphery of the foundation, a plurality of wall sections mounted on the sole plate and connected in abutting relation to adjacent wall sections, and a top plate mounted on top of the wall sections. Each of the wall sections includes a panel having two opposite lateral edges, a bottom edge extending alongside and secured to the sole plate and a top edge extending alongside and secured to the top plate. A lateral edge of one panel abuts against the lateral edge of a panel of an adjacent wall section, and a stud secured to one lateral edge of the panel projects beyond the one lateral edge and extends to a core recessed from a lateral edge of a panel of an adjacent wall section so that the stud is covered partially by a panel of one wall section and partially by a panel of an adjacent wall section.

It is yet another object of the present invention to provide a method of building a structural housing unit by laying a foundation, securing a sole plate to the foundation in a pattern with corners, securing a plurality of prefabricated wall sections to the sole plate to form a plurality of walls having terminal edges spaced from each other at the corners, securing a top plate to the wall sections following the pattern of the sole plate, and interconnecting the terminal edges at the corners with a series of studs extending between the top plate and the sole plate.

It is still another object of the present invention to provide a process for manufacturing prefabricated wall sections by feeding a panel in a predetermined direction, applying an adhesive to the panel as it is being fed, locating the panel on top of a plurality of wall section components, and pressing the panel onto the components for a predetermined period of time to secure the panel to the components.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
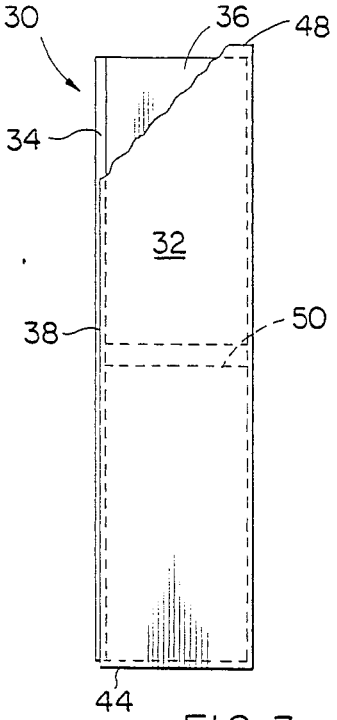
FIG. 1 is a front view of a wall panel with a portion broken away.
Figure 2:
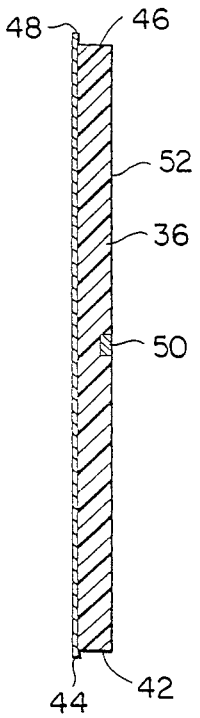
FIG. 2 is a side view of the wall panel shown in FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 20, in particular, prefabricated wall panels embodying the teachings of the subject invention are disclosed. In these Figures, a series of parallel diagonal lines represent an expanded polystyrene (EPS) section, a pair of crossed diagonal lines represents a stud, and a single diagonal line represents a jack stud which supports a header or lintel. Typically, a $2\times6$ inch stud actually measures $1\frac{1}{2}$ inches by $5\frac{1}{2}$ inches. In addition $\frac{5}{8}$ inch thick wafer board is used as the panel secured to the EPS section, studs and jack studs.

Wall panel 30 shown in FIG. 1 includes a $2\times8$ foot section of wafer board 32, $2\times6$ inch stud 34 and EPS section 36. Stud 34 and EPS section 36 are secured to wafer board 32, preferably by gluing and nailing, or by other means of attachment. Wafer board 32 forms an exterior surface of the wall panel.

Stud 34 extends beyond lateral edge 38 of wafer board 32 by $\frac{3}{4}$ inch. On the opposite side of wall panel 30, opposite lateral edge 40 projects beyond recessed EPS section 36 by $\frac{3}{4}$ inch. The extension of stud 34 beyond edge 38 and the projection of wafer board lateral edge 40 provides for interconnection of a series of adjacent wall panels. A bottom edge 44 of wafer board 32 projects beyond a bottom edge 42 of EPS section 36 by $1\frac{1}{4}$ inch for mounting of the panel 30 on a sole plate and for covering the sole plate by bottom edge 44. Likewise, top edge 48 of wafer board 32 projects beyond top edge 46 of EPS section 36 by $2\frac{1}{8}$ inch to accommodate a top plate, preferably a double top plate. It is contemplated that a second story of construction can be mounted above a wall made up of a series of interconnected wall panels.

Optional 2×4 inch stud 50 is shown mounted transversely across surface 52 of EPS section 36. Stud 50 provides a nailing surface for attachment at the construction site of an interior wall to wall panel 30 or attachment of a cabinet on surface 52.

The $5\frac{1}{2}$ inch depth of EPS section 36 is substantially equal to the depth of stud 34. Surface 52 of EPS section 36 and an inner edge of stud 34 provide a smooth interior surface which is later covered by an interior wall after the wall panel 30 has been erected at a building site.

Figure 21:
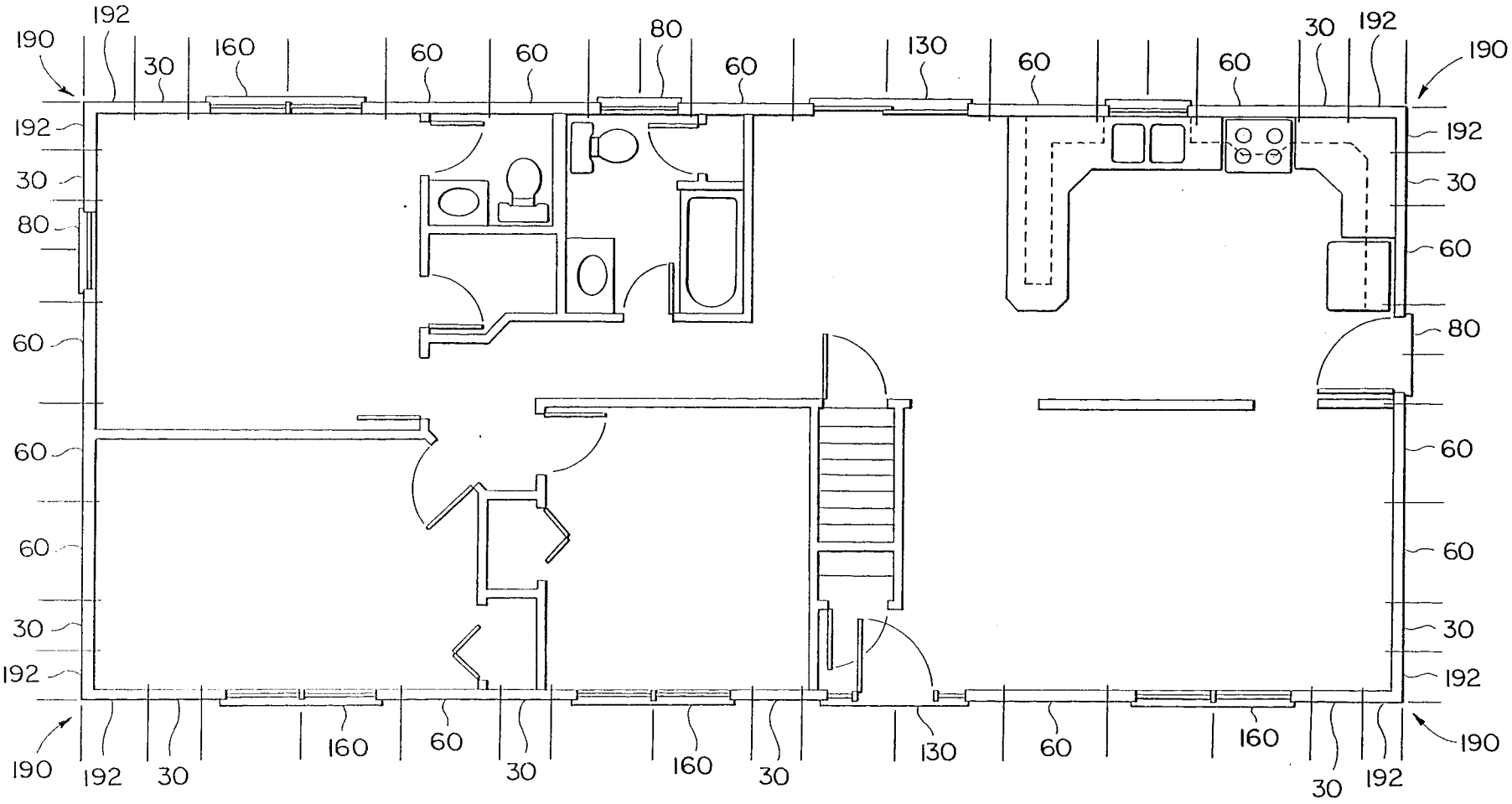
FIG. 21 is a schematic view of a floor plan using a series of prefabricated wall panels.

The wall panels shown in FIGS. 4 through 17 provide, similar to FIG. 1, a stud extending beyond a lateral side edge of the wafer board and either an EPS section or a jack stud recessed from the opposite lateral side edge of the wafer board The portion of the stud which projects beyond the lateral side edge of the wafer board fits into the "lap" recess of an adjacent wall panel and is nailed through the wafer board. Similarly, the projecting edge of the opposite lateral side edge of the wafer board overlaps the stud of an adjacent panel and is nailed to the stud. This interconnection of adjacent panels is shown in FIG. 21 and will be explained further with reference to that Figure.

Figure 4:
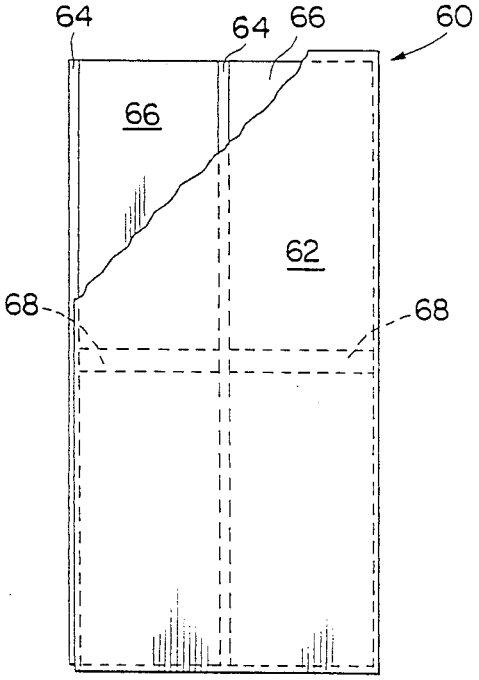
FIG. 4 is a front view of a wall panel with a portion broken away.
Figure 3:
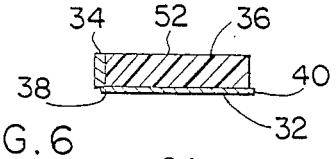
FIG. 3 is a top plan view of the wall panel shown in FIG. 1.
Figure 5:
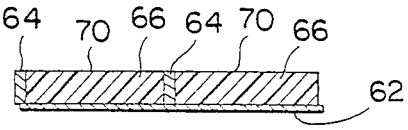
FIG. 5 is a top plan view of the wall panel shown in FIG. 4.

In FIGS. 4 and 5, wall panel 60 is shown. Wall panel 60 includes 4×8 foot section of wafer board 62, two 2×6 inch studs 64 and two EPS sections 66. Optional 2×4 inch nailing strip studs 68 are shown in phantom in FIG. 4. These nailing strips are mounted in the inner surfaces 70 of EPS sections 66 in a manner similarly disclosed for nailing strip 50 shown in FIGS. 1 and 2. Wall panels 30 and 60 are used for forming wall sections of a housing unit where no particular alterations to the wall are to be made such as the mounting of windows, patio doors or bay windows, for example.

Figure 6:
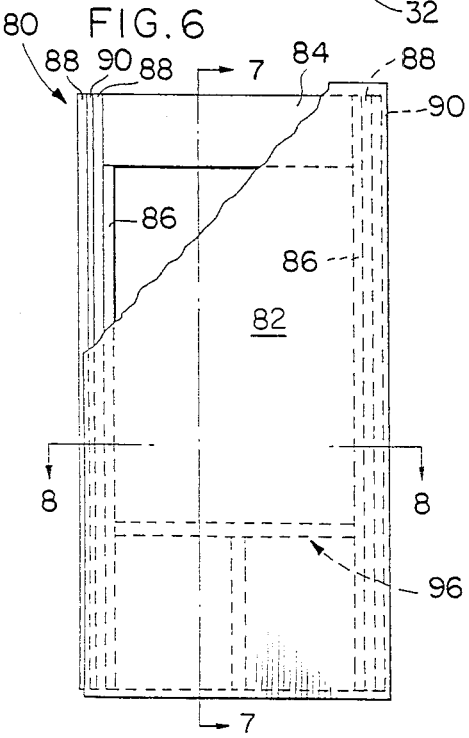
FIG. 6 is a front view of a wall panel with a portion broken away.
Figure 7:
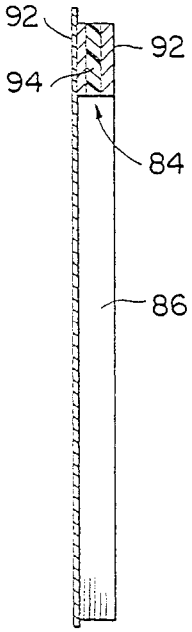
FIG. 7 is a sectional side view of the wall panel shown in FIG. 6, taken along the line 7—7.
Figure 8:
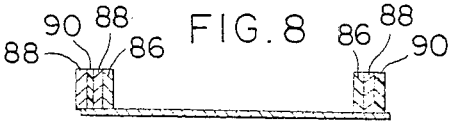
FIG. 8 is a sectional view of the wall panel shown in FIG. 6, taken along the line 8—8.

In FIGS. 6 through 8, wall panel section 80 is shown. Wall panel 80 is used to accommodate a three foot wide door or, upon alteration at the construction site, will accommodate a three foot wide window. Panel 80 includes 4×8 foot wafer board section 82 and $11\frac{1}{4}$ inch height header 84 which extends partially along the top edge of wafer board section 82.

On one side of the header 84 is a 2×6 inch support jack stud 86. Adjacent to stud 86 is 2×6 inch stud 88, and in a progressively outward direction is an EPS strip 90 and another stud 88. On the opposite side of the header 84 is a jack stud 86, followed in a progressively outward direction by 2×6 inch stud 88 and EPS strip 90. Header 84 includes two 2×12 inch support studs 92 with an EPS strip 94 located therebetween.

Since an opening will be cut in wafer board 82 to accommodate a door or window, header 84 supports the load on wall panel section 80. As shown in phantom lines, for illustration purposes only in FIG. 6, support 96 may be added at the construction site as a support or a window.

Figure 9:
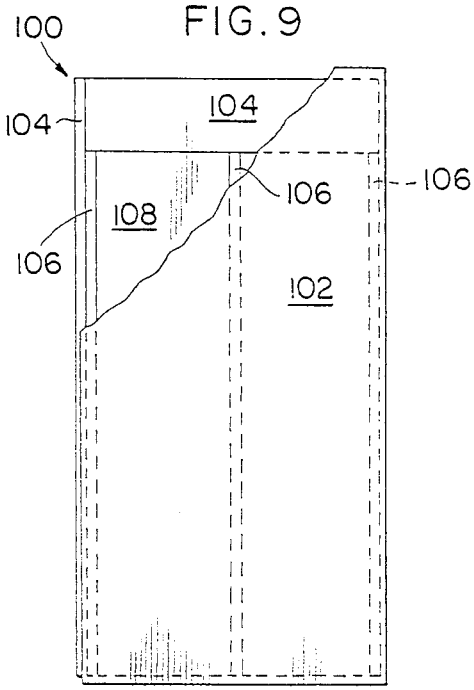
FIG. 9 is a front view of a wall panel with a portion broken away.
Figure 10:
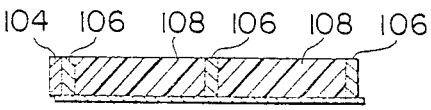
FIG. 10 is a bottom plan view of the wall panel shown in FIG. 9.

In FIGS. 9 and 10, wall panel section 100 is shown. Wall panel section 100 includes 4×8 foot wafer board section 102, header 104, 2×6 inch stud 104, 2×6 inch jack studs 106 and EPS sections 108. Panel section 100 may be used for a double casement window upon removal of portions of EPS sections 108 and the addition of a transversely extended support, which would be added at the construction site. Header 104 is similarly constructed as header 34 shown in FIGS. 6 and 7.

Figure 11:
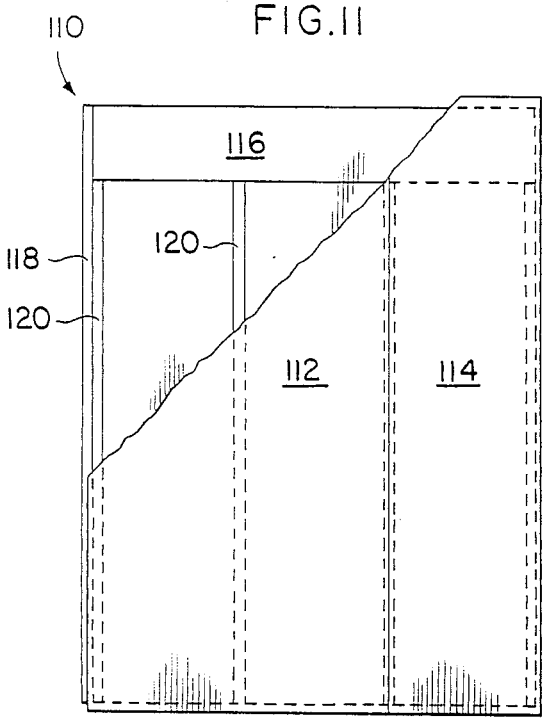
FIG. 11 is a front view of a wall panel with a portion broken away.
Figure 12:
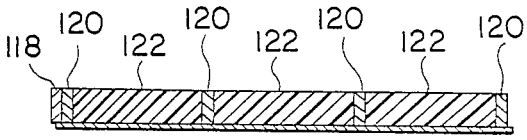
FIG. 12 is a bottom plan view of the wall panel shown in FIG. 11.

In FIGS. 11 and 12, wall panel section 110 is shown. Wall panel section 110 includes 4×8 foot wafer board section 112, 2×8 foot wafer board section 114, header 116, 2×6 inch stud 118, 2×6 inch jack studs 120 and EPS sections 122. Wall panel section 110 can accommodate double casement windows or a 5 foot wide patio door upon alteration at the job site. Header 116 is similarly constructed as header 34 shown in FIGS. 6 and 7.

Figure 13:
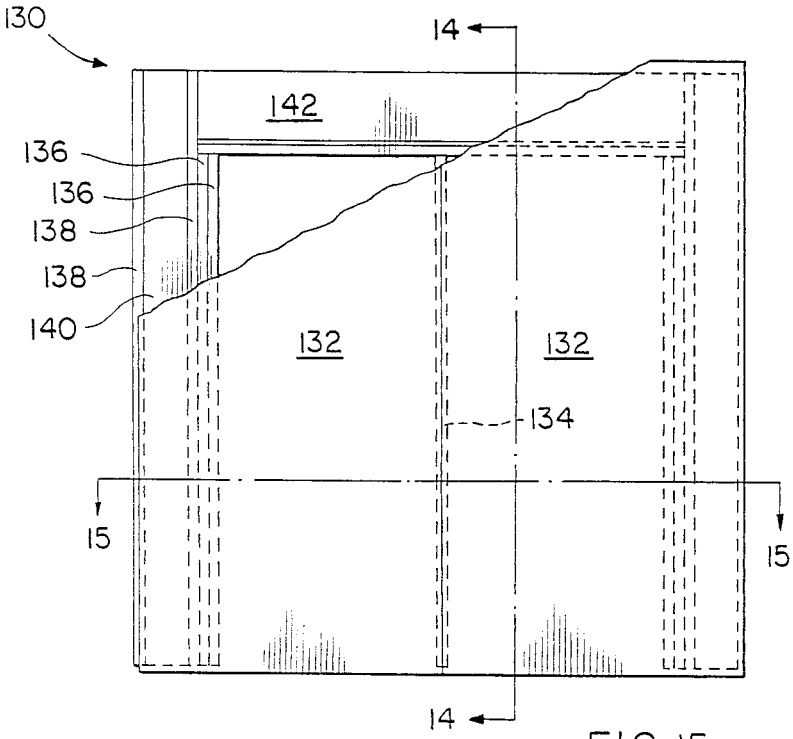
FIG. 13 is a front view of a wall panel with a portion broken away.
Figure 14:
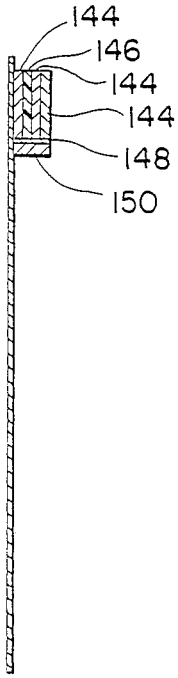
FIG. 14 is a sectional view of the wall panel shown in FIG. 13, taken along the line 14—14.
Figure 15:
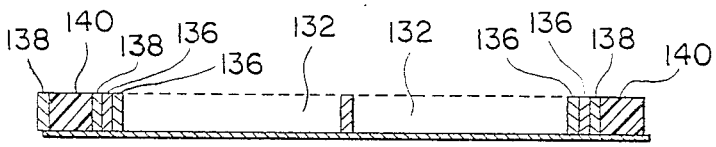
FIG. 15 is a sectional view of the wall panel shown in FIG. 13, taken along the line 15—15.

In FIGS. 13 through 15, wall panel section 130 is shown. Wall panel section 130 includes two 4×8 foot wafer board sections 132, 2×6 inch jack stud 134, 2×6 inch jack studs 136, 2×6 inch studs 138, EPS sections 140 and header 142. Header 142 includes three 2×12 inch support studs 144 and a one inch thick EPS strip 146, which are supported by $\frac{5}{8}$ inch plywood strip 148 and 2×6 inch spacer stud 150. Jack stud 134, plywood strip 148 and spacing stud 150 are installed at the factory for strengthening of the wall panel section during shipping. They can be removed at the construction site, along with alteration of the wafer board sections 132 for installation of a patio door in the panel wall section 130.

Figure 16:
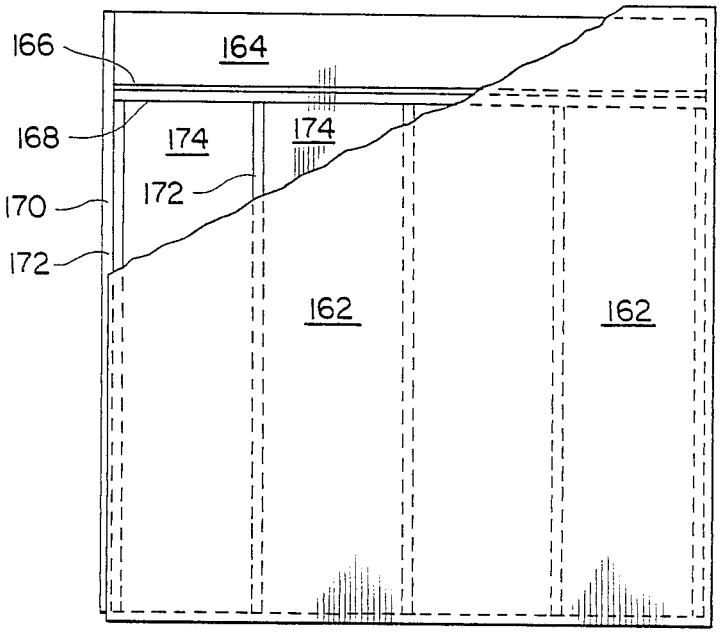
FIG. 16 is a front view of a wall panel with a portion broken away.
Figure 17:
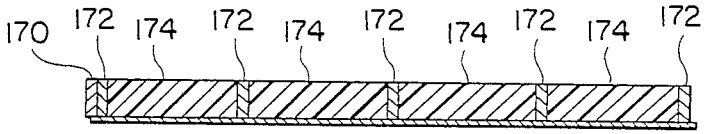
FIG. 17 is a bottom plan view of the panel shown in FIG. 16.

In FIGS. 16 and 17, wall panel section 160 is shown which is used for forming a patio door, French doors, bay window or picture window. The wall panel section 160 includes two 4×8 foot wafer board sections 162, header 164, $\frac{5}{8}$ inch plywood strip 166, 2×6 inch spacer stud 168, 2×6 inch stud 170, jack studs 172 and EPS sections 174. The header 164 is similarly constructed as header 142 shown in FIGS. 13 and 14.

Figure 18:
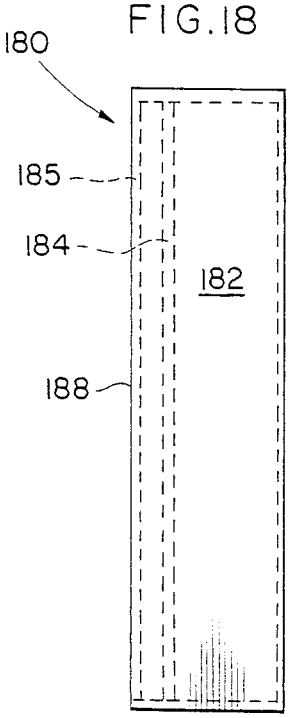
FIG. 18 is a front view of a wall panel.
Figure 19:
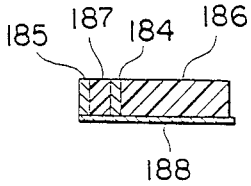
FIG. 19 is a top plan view of the panel shown in FIG. 18.

In FIGS. 18 and 19, wall panel section 180 is shown. The wall panel section 180 includes 2×8 foot wafer board section 182, two 2×6 inch studs 184 and two EPS sections 186 and 187. Wall panel section 180 is used at the corner of a wall which is made up of a series of interconnected wall panel sections. An outermost edge of stud 185 is aligned with a lateral edge 188 of wafer board section 182. Stud 184 is spaced from stud 185 by a distance of $3\frac{1}{2}$ inches so that in a corner of a building, stud 184 would be available to have gypsum board nailed into it from the inside of the building.

Figure 20:
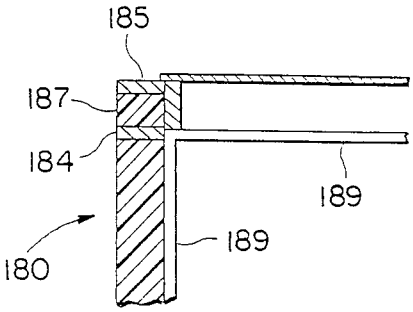
FIG. 20 is a schematic plan view of a corner construction.

As shown in FIG. 20, wall panel 180 is positioned at the corner of a building. Abutting against wall panel 180, at an angle of 90 degrees, would be another wall panel 180 or a stick built construction which will fill in the gap of a wall approaching a corner vertex. Gypsum board 189 would be nailed from the interior of the building into stud 184.

To assemble a structural housing unit using any combination of the wall panel sections illustrated in FIGS. 1 through 20, a masonry or concrete foundation is first formed at the construction site. A sole plate is mounted on the foundation about the periphery of the foundation. The sole plate forms the configuration of the first floor of the housing unit. Starting at a distance not greater than 3 foot 11 inches from an adjacent corner, a first wall panel section is mounted on the sole plate. Additional sections of wall panels are mounted on the sole plate 198 in abutting relation to an adjacent wall panel. Adjacent wall panels are nailed together by nailing of a projecting lateral edge of a wafer board section of a wall panel onto a projecting portion of a stud extending from a lateral edge of a wafer board section of an adjacent wall panel.

Figure 22:
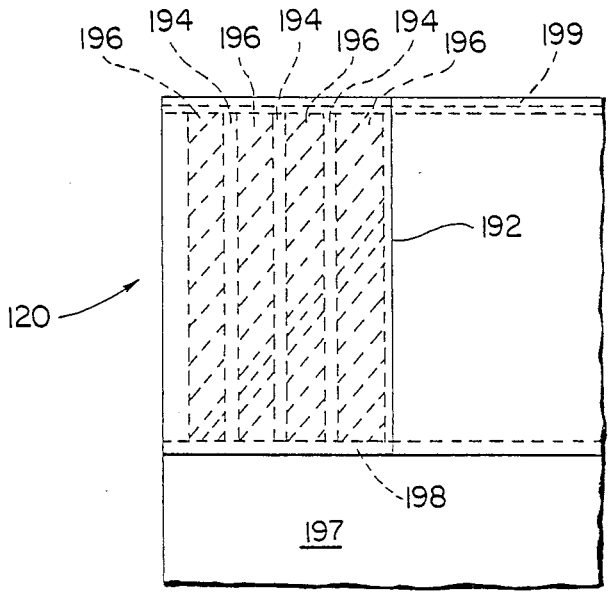
FIG. 22 is a side view of a corner of the structural housing unit shown in FIG. 21.

In FIGS. 21 and 22, a preferred assembly of a plurality of wall panels is shown. Starting in one area, in this example, the kitchen area of the house, a wall panel section 30 is mounted on the sole plate 198 which has been secured to the foundation 197. A wall panel section 60 is then mounted on the sole plate adjacent to wall panel section 30 and pushed into abutment with the wall panel section 30. Stud 34 is overlapped by a projecting edge of wafer board panel 62 which abuts against lateral edge 38 of wafer board panel 32. The abutment of lateral edges of adjacent panels forms a tight seal shell having improved thermal and sound insulation qualities.

Mounting of adjacent wall panel sections is continued until a series of interconnected panels form a wall extending between two corners of the housing unit. After leaving a space less than approximately 3 feet, 11 inches at the corner, a first wall panel section is mounted on the sole plate to initiate formation of another wall. The next wall of the housing unit is constructed by interengaging adjacent wall panel sections to complete the wall, stopping short of the corner vertex by less than approximately 3 feet, 1¹ inches.

A top plate 199 is mounted across the top surface of the wall panel sections and fitted in the recess formed by the top surface of the wafer board panels projecting above the top surface of the core material. Preferably, a double top plate, as shown in FIG. 22, is used. Such a series of interconnected wall panels is shown in FIG. 21.

At each corner 190, the space between the terminal edge 192 of a wall and the corner is filled in with stick built type construction extending between the sole plate 198 and the top plate 199. The gaps between adjacent studs 194 of stick built construction are filled in with field cut EPS sections 196. By this method, any inaccuracies in the foundation structure 197 are compensated for since the corner stick construction is not limited to the predetermined dimensions of a prefabricated wall panel.

Once all the walls of the housing unit have been assembled and the corners 190 have been filled in with stick built construction, all electrical and plumbing fixture installation is performed. The EPS sections are readily recessed by a hot wire gun to house plumbing and electrical fixtures and connections. In addition, all windows and doors are installed in the appropriate locations by alteration of wall panel sections.

The interior surface of the wall panels are then covered with gypsum board which is nailed to the studs of adjacent wall panels. Optionally, plastic weatherproofing sheets are applied to the interior of the wall panel sections to form a vapor barrier prior to sealing the interior surface of the wall panels with gypsum board.

Since the wall panel sections are shipped and erected with an exposed interior surface, all electrical and plumbing connections are readily accessible for inspection prior to the sealing of the walls with gypsum board. In addition, if any parts of a wall panel section are damaged they can be easily removed and replaced. Further, the horizontal edge seams of the exposed inner surface of the wall panels provide a guide for aligning gypsum board as it is applied at the construction site.

Figure 23:
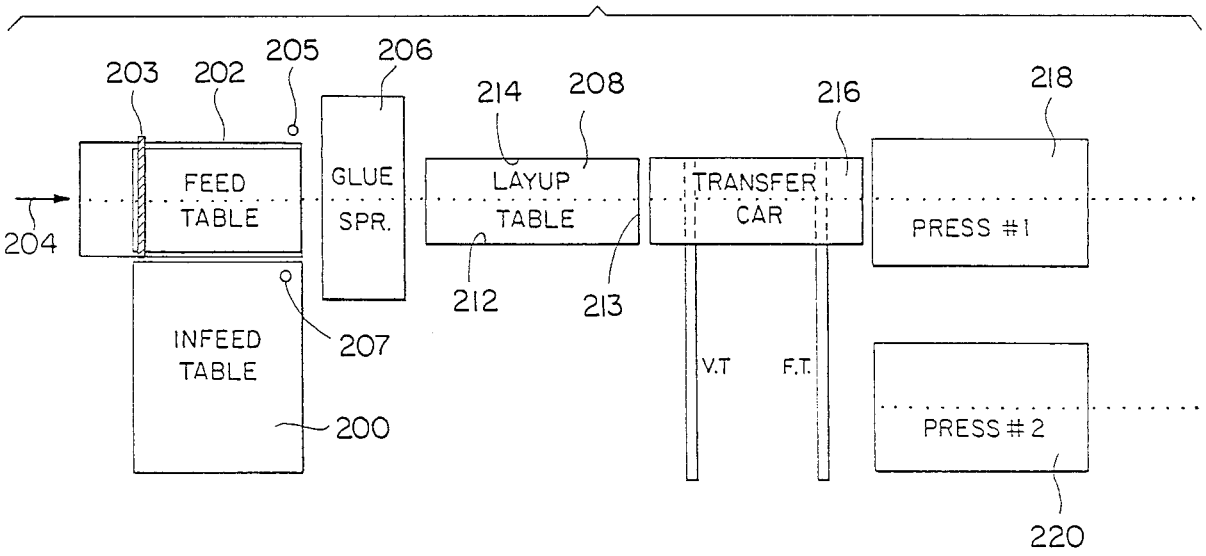
FIG. 23 is a schematic diagram illustrating a system for assembling of wall panels.

The manufacture of the wall panels of the present invention will be described with reference to FIG. 23. In FIG. 23, infeed conveyor 200 includes three sets of parallel roller ramps. The roller ramps are elevated above the floor. A space is provided between each adjacent roller ramp so that a fork lift may deposit a stack of fifty wafer board panels on the roller ramps.

Feed table 202 is adjustable in height by a hydraulic scissor arrangement and includes three roller ramps which are aligned with the three roller ramps of the infeed conveyor 200. The feed table is lowered to the same height as the infeed conveyor and the stack of wafer board panels located on the infeed conveyor are manually pushed onto the feed table. The feed table is then raised until the top panel of the stack of wafer board panels is positioned at an infeed height.

A hydraulically controlled scraper 203 is actuated to push off the top panel of the stack and move the top panel in a feed direction as shown by arrow 204. After the first panel is fed by the scraper, a photocell 205 detects the absence of a panel at the infeed height and causes the feed table to rise automatically to a height so that a second panel is at the infeed height. This sequence is repeated until the final panel has been advanced. After the final panel has been advanced, a photocell 207 detects that the feed table is empty. The feed table is then lowered to a stack receiving position. The feed table is now ready for a new stack of panels to be pushed onto the feed table from the infeed conveyor.

The scraper 203 causes each of the wafer board panels to pass through a glue spreader 206. The glue spreader includes two rollers. Adhesive is preferably applied only by the bottom roller to the bottom of the panel. The coating roller is running at a feed rate which approximates the speed at which panels are pushed off the feed table into the glue spreader. Panels received from the feed table are passed to the layup table 208 through glue spreader 206 with a continuous coat of adhesive applied to at least one face, preferably the bottom face, ready to be attached to the other components of the wall panel assembly.

Before the assembly line operator initiates the feed process to the layup table 208, the other wall panel sub-components are assembled on the layup table. The surface of the layup table includes a roller to facilitate transfer of completed wall panels. The layup table is vertically adjustable in height by a hydraulic scissor arrangement.

An operator first causes an air operated guide having a height greater than a 2×6 inch stud to be swung into position adjacent the short side 210 of layup table 208. A 2×6 inch stud is then placed against a fixed position guide located at long side 212 of layup table 208. A spacing stud is placed against the short side air operated guide. The spacing stud has a height less than a 2×6 inch stud and has a $1\frac{1}{4}$ inch width sufficient to provide a $1\frac{1}{4}$ recess for the top edge of the core material from the top edge of a wafer board panel. Following this, the operator places other wall panel components including EPS panel sections, studs, jack studs and headers, depending upon the type of wall panel to be produced, in alignment with the studs located against the guides positioned at the long side 212 and the short side 210 of the table 208.

Two more air operated guides are then actuated to be swung up and to extend along the long side 214 of layup table 208 One of these two long side 214 guides is $\frac{3}{4}$-inch thick and is of a height less than a 2×6 inch stud. This guide contacts the EPS section(s) and other components to compress the components against the fixed guide on opposite long side 212. This facilitates the final step of nailing the $\frac{5}{8}$ inch wafer board panel onto the studs. The other of the two long side 214 guides extends just above the height of a 2×6 inch stud to act as a guide for the edge of the wafer board as it is fed through the glue spreader.

After turning on the glue spreader, a wafer board panel is stripped off the top of the stack of wafer board panels on the feed table and fed through the glue spreader with adhesive being applied to the bottom of the panel. Two operators, one positioned on each side of the layup table, catch the panel as it is fed through the glue spreader. The operators position the wafer board panel against the higher elevationed air operated guide on long side 214 and above the other long side 214 guide to provide a $\frac{3}{4}$ inch projection for the panel edge from the core material on long side 214. The operators also position the panel on the short side 208 against the air operated guide which facilitates the $1\frac{1}{4}$ inch projection of the wafer board from the core material and stud at the bottom of each panel. The assembled components are dimensioned so that the top edge of the panel projects beyond the core material and stud at $2\frac{1}{8}$ inches. The operator then nails the wafer board panel to the studs with a retractable overhead pneumatic air nailing gun.

After the panel has been assembled, an operator removes the $1\frac{1}{4}$ inch spacing stud and causes the one air operated guide at short side 210 and the two air operated guides at long side 214 to retract. The layup table is then lowered approximately six inches to position the top surface of the assembled panel at a working height to facilitate receipt of another wafer board panel through the glue spreader and onto the assembled components of another wall panel. The air operated guides remain at a fixed height and do not move with the layup table.

The process is then repeated for the assembly of wall panels on the layup panel until a maximum height stack of wall panels, preferably 10 panels, has been completed. A maximum height is achieved by the layup table not being able to lower any further to accommodate another panel. The layup table is then raised, if necessary, to position the lowermost panel level with transfer car 216, preferably 16 inches above floor level.

The stack of panels is then manually pushed from the layup table to the transfer car 216 for movement of the wall panels to one of two presses 218 and 220. The transfer car includes rollers for the transfer of wall panels off of the transfer car.

The completed stack of wall panels are manually pushed from the transfer car into an empty press 218 or 220. The press includes two plattens which are spaced sufficiently apart to receive the stack of panels. The stack is centered on the press before the plattens begin pressing towards each other. The top platten is lowered until engaging the stack of panels and a predetermined pressure is applied. Pressing continues for a period of approximately 30 minutes.

After the pressing cycle is complete, the plattens are released. The stack of finished panels is picked up from a side of the press opposite from the transfer car for movement by a fork lift to a storage area.

While press 218 is pressing a stack of panels, another stack of panels is being formed at the layup table which will be transferred to press 220 for final curing of the adhesive. The production rate of panels at the layup table is of sufficient duration so that one press is always available for receipt of a finished stack of panels.

Having described the invention, many modifications thereto will become apparent to those skilled in the art to which it pertains without deviation from the spirit of the invention as defined by the scope of the appended claims.

I claim:

1. A method of building a structural housing unit, said method comprising:

laying a foundation, securing a sole plate to said foundation in a pattern having corners, forming an exterior surface of a plurality of walls from a plurality of prefabricated wall sections having an exposed interior surface adapted for access to the interior of the walls to perform such functions as installation and inspection of plumbing and electrical lines in recesses formed from said exposed interior surface, said exterior surface being formed by securing said plurality of prefabricated wall sections to said sole plate while spacing terminal edges of said wall sections from each other at said corners, securing a top plate to said wall sections, following the pattern of said sole plate, and interconnecting said terminal edges at said corners with a series of studs extending between said top plate and said sole plate.

2. A method of building a structural housing unit as in claim 1, including placing said plurality of prefabricated wall sections with an exterior panel overlapping said sole plate and said top plate.

3. A method of building a structural housing unit as in claim 1, including placing expanded polystyrene between adjacent studs at said corners.

4. A method of building a structural housing unit as in claim 1, including securing said plurality of prefabricated wall sections to said sole plate in abutting relation.

* * * * *